US011482103B2

(12) United States Patent
Vaudrin et al.

(10) Patent No.: US 11,482,103 B2
(45) Date of Patent: Oct. 25, 2022

(54) CONTROL AND MANAGE TRAFFIC LIGHT SYSTEM WITH VANET

(71) Applicants: François Vaudrin, Quebec (CA); Laurence Capus, Quebec (CA)

(72) Inventors: François Vaudrin, Quebec (CA); Laurence Capus, Quebec (CA)

( * ) Notice: Subject to any disclaimer, the term of this patent is extended or adjusted under 35 U.S.C. 154(b) by 0 days.

(21) Appl. No.: 16/198,788

(22) Filed: Nov. 22, 2018

(65) Prior Publication Data

US 2020/0168083 A1 May 28, 2020

(51) Int. Cl.

| | |
|---|---|
| ***G08G 1/07*** | (2006.01) |
| ***G08G 1/08*** | (2006.01) |
| ***G08G 1/095*** | (2006.01) |
| ***G08G 1/081*** | (2006.01) |
| ***G08G 1/087*** | (2006.01) |

(52) U.S. Cl.

CPC ..... *G08G 1/08* (2013.01); *G08G 1/081* (2013.01); *G08G 1/087* (2013.01); *G08G 1/095* (2013.01)

(58) Field of Classification Search

CPC ..... G08G 1/08; G08G 1/081; G08G 1/087; G08G 1/095; G08G 1/0112

See application file for complete search history.

(56) References Cited

U.S. PATENT DOCUMENTS

| | | | | |
|---|---|---|---|---|
| 9,691,278 | B2 * | 6/2017 | Poornachandran | G08G 1/096783 |
| 10,490,066 | B2 * | 11/2019 | Green | G06V 20/54 |
| 2017/0032670 | A1 * | 2/2017 | Poornachandran | G08G 1/096775 |
| 2017/0186314 | A1 * | 6/2017 | Bernhardt | G08G 1/0133 |
| 2017/0222913 | A1 * | 8/2017 | Chia | G08G 1/09675 |
| 2017/0270785 | A1 * | 9/2017 | Umehara | G08G 1/0112 |
| 2018/0096595 | A1 * | 4/2018 | Janzen | G06K 9/0063 |
| 2018/0158329 | A1 * | 6/2018 | Benhammou | G08G 1/096716 |
| 2018/0336781 | A1 * | 11/2018 | Jin | G08G 1/07 |
| 2020/0035096 | A1 * | 1/2020 | Sun | G08G 1/082 |
| 2020/0334979 | A1 * | 10/2020 | Gon Alves | H04B 1/59 |

* cited by examiner

*Primary Examiner* — Toan N Pham

(57) ABSTRACT

The programming of traffic lights systems (TLS) in cities is a complex optimization problem. The main problem of the actual process is that this is a long, expensive and imprecise process that must be repeated regularly to reflect changes in traffic flow. The invention consists of using Vehicular's ad hoc networks (VANET) to collect traffic data in real time and transmit them to a traffic management system. VANET is currently defined by the IEEE 802.11p standard. We propose to use VANET in correlation with others techniques to control TLS. This invention will permit to program actual TLS more efficiently, manage a network in real-time and it will be possible to be used for urban planning studies, transport planning or to simulate the exit of special events (sporting, cultural, parades, etc.). It also allows programming TLS in real time with any efficient algorithm that exists or to be developed.

21 Claims, 5 Drawing Sheets

CONTROL AND MANAGE TRAFFIC LIGHT SYSTEM WITH VANET

BACKGROUND OF THE INVENTION

The present invention belongs to the field of systems used to control and to manage the traffic light for providing a fluid circulation.

Existing Current Systems

The programming of traffic lights systems (TLS) in cities is a complex optimization problem. The majority of TLS in cities are controlled by electromechanical systems or microprocessors. Few systems are designed to control real-time TLS and to our knowledge no city can automatically control a major TLS in real time.

Generally, a programming plan for TLS is preprogrammed to during certain periods of the day and of the week (e.g. From 15:00 to 18:00). This plan is subsequently applied over several years. Moreover, even during peak periods, there are vehicles flow variations. This methodology can not take into account these variations because the arrival of vehicles is simulated by statistical methods as Poisson law. My invention would provide the exact distribution of vehicle movement because it gives the position and speed of each vehicle every 0.1 sec or less. Moreover, semi-actuated or fully-actuated systems allow to change the duration of the cycles but they require the installation of detector loops under the pavement and these systems are not installed throughout the network. In addition, there are significant costs to maintain these systems. My invention will replace these detection loops and provide more accurate information to the controller who manages the traffic lights located at the street intersection.

The current procedure recommended by the Institute of Transportation Engineers (ITE) for programming TLS is shown in FIG. 1. This is a complex, lengthy and costly process that need to be revised regularly. This method is used in most cities, agencies, and public administrations and is still the most reliable method available. This process is done with historical circulation data. It is from these data that traffic engineers and transportation experts determine which system programming to apply. Modeling is usually done by using specialized simulation softwares. These software can model various optimization scenarios and provide performance measures (waiting time, means speed, length of queues, etc.). This is an iterative process which requires the circulation expert to apply a variety of scenarios until he finds a satisfactory solution. The solution that seems the best is then retained and is validated again before implementation on the site (Implement and Fine Tune see FIG. 1). Programming is carried out on one or many junctions. When the TLS plan is established it is kept unchanged for several years.

The key ingredient of the ITE process is based on the reliability of the data collected from the field, from origin-destination surveys or by other means.

Despite all the modern technology available, some studies are best conducted manually. The use of automated equipment requires set-up and effort that may not be practical. Certain types of information are difficult to obtain without direct manual observation. For example, turning movements at an intersection are difficult to track without direct manual observation. Although the size of vehicles can be used to determine the vehicle class (truck, bus, car), it cannot discern the difference between a private automobile and a taxi for example. Manual observations can be supported by a variety of hand-held devices (Hands Counters, Radars meters, etc.) that assist in the recording of data or can be fully manual using paper forms to record data. Semi automated methods rely primarily on the use of pneumatic road tubes and a wide variety of recording devices that can be connected to such tubes. These devices are generally portable so they can be moved from location to location. Others portable devices can also be used. Fully automated studies rely on a wide variety of permanently installed detectors or sensors, usually in conjunction with connections to a stationary or portable computer station. The same permanent detectors and sensors are also used to operate actuated and/or adaptive signals. The growth of sensor technology is moving in this direction that is to say by installing these devices on large-scale networks.

(Reference: Traffic Engineering Manual, Fourth Edition, Roger P. Roess, Elena S. Prassas, William R. McShane, ch. 8, 2011).

My invention is based on a completely different paradigm. It is no longer sensors or other devices that are looking to find position of vehicles or flow traffic, but it is vehicles that transmit their position, speed and other information to the system at every split second. Thus, it is no longer necessary to do manual counts or install sensors to obtain traffic data. It will enable to collect traffic data more accurately without manual counting and without installing sensors on a large scale.

The goal of data collection is to count the number of vehicles that pass to a certain location. It is sometime necessary to send a technician on the field to manually count the number of vehicles that pass each junction and in both directions.

These data are used to establish means and to ensure that it reflect as closely as possible the reality. These data represent roughly the circulation flow that will be use during a simulation or for calculations.

In my invention the traffic lights can be programmed by using the data collected with VANET. Thus, there is no need to get on site to get these data manually or to install sensors. Also, TLS can be updated regularly or as necessary, in function of the data collected by VANET.

My Invention

My invention specifically relates to the data collection process and its ingenious use as I propose in the figures and in this document; with my invention, there is no need of someone to collect the data by staying on the road. The data are collected by using VANET and they are utilized in a database. My invention consists among others to collect traffic data with VANET to program the current TLS. The programming of the current TLS is based on historical traffic flow data measured on site (for example by manual counting). The invention consists in using VANET to collect these traffic data and to use them to program the current TLS (static or adaptive with detection loops). My invention makes it possible to obtain more accurate data and more economically than the methods used by cities, government agencies or public administrations.

The main reason why VANET was invented at the beginning of 2000 years is to improve safety on roads. This is done for instance by providing information to drivers in vehicles. My invention consists of using Vehicular's ad hoc networks (VANET) to collect traffic data and transmit them to a traffic management system. This is not the same use as initially planned by VANET. VANET is currently defined by the IEEE 802.11p standard. In VANET every vehicle acts as a node of a temporary network. Each vehicle can receive information from other vehicles every split second (0.1 sec or less) regarding their status in a range of about 300 meters. The available information from VANET is about speed, acceleration, position of each vehicle, the braking system and so on.

This information is transmitted to communication stations installed along the road—Road Side Unit (RSU) and relayed to a Base Station (see FIG. 2). This is called a communication mode from vehicle to vehicle (V2V), Vehicle to Infrastructure (V2I), and Infrastructure to Infrastructure (I2I). VANET operates on a dedicated frequency spectrum 75 MHz bandwidth and 5.9 GHz allocated by governmental authorities. Furthermore, VANET can operate in variable weather conditions (rain, fog, snow).

Note that the IEEE 802.11p standard is an amendment to the IEEE 802.11 standard. In Europe, Asia or other continents, the standard can be adapted or renamed according to the rules of international standardization bodies that may be different in some countries or regions of the world. For example, in Europe, 802.11p was used as a basis for the standard ITS-G5, supporting the GeoNetworking Protocol for Vehicle and Infrastructure. The intention of the international standardization bodies is to make the standards in relation to VANET as compatible as possible (whatever name they are given).

We propose to use this technology to collect data and pass it to a system installed in a control centre (FIG. 3 and others). It will then be possible to use these data to test a variety of scenarios for programming TLS like circulation expert do actually in the ITE process describe previously and shows on FIG. 1. It will also be possible to use these date for other uses like urban studies.

The method of data collection and the architecture of my systems is described in an article presented at the 2016 SUMO Conference at the German Aerospace Center DLR in Berlin, Germany. (*Improving Traffic Lights Management Sytems Using Information Available by VANET*, François Vaudrin, eng., Laval University and Laurence Capus, Ph.D., Laval University, Conference SUMO 2016—Traffic, Mobility, and Logistics, Proceedings, Berlin).

No invention, PCT, patent or patent pending offers an invention as precise and functional as mine which is based on the standards and the methodology in force for the programming of traffic lights systems.

No invention, PCT, patent or patent pending offers an invention as precise and functional as mine which use data from VANET to perform the same work as actual adaptive systems.

No invention, PCT, patent or patent pending offers an invention as precise and functional as mine to use data from VANET to manage and control TLS in real time.

No invention, PCT, patent or patent pending offers an invention as precise and functional as mine to use data from VANET to help to control circulation and TLS with human traffic officers.

No invention, PCT, patent or patent pending offers an invention as precise and functional as mine to use data from VANET to make different urban studies.

Benefits of My Invention

My invention is more accurate and complete than conventional methods. My invention will permit to collect more data for simulations and to respect the ITE process.

Also, it is necessary to do manual counting on the field or to install sensor and other expensive equipment like cameras and loop detectors to collect circulation data. These expensive processes will no longer be necessary with my invention. Data collection with my method invention is more simple, less expansive and requires little maintenance.

The advantage of my invention is that it is possible to obtain a multitude of parameters every split second (speed, position of each vehicle, distance between each vehicle and so on). A public administration will have the possibility to revise the programming plans as often as desired. Once a change is observed, it will be possible to quickly do a simulation without returning to the field to get new measures because the system will give them data in real time.

It should be noted that my invention does not claim rights to any particular algorithm but claims an innovative method for providing accurate information and data for developing new algorithms to program actual TLS (static or adaptive with loops detections) or to control TLS in real-time, particularly in the field of artificial intelligence.

These parameters are not currently available and will allow circulation, transport and computer experts to make more accurate models and develop new and more efficient algorithms.

My invention provides also the necessary ingredients to implement any effective algorithm validated by simulation software. My invention will permit to manage a complex TLS network in real.

It will transmit data to the control center that will treat them with an appropriate algorithm and transmit the instructions using a dedicated Internet network to wireless devices installed at each junction.

My invention is sufficiently detailed to allow a public administration to implement it while using their own working methods and without significantly altering their infrastructure.

This method also allows to be used in other contexts, for urban planning studies, transport planning or to simulate the exit of special events (sporting, cultural, festivals, parades, etc. The present invention will be further understood from the following description with reference to the drawings wherein like numbers refer to like parts for easy identification.

BRIEF DESCRIPTION OF DRAWINGS FIGURES

DETAILED DESCRIPTION OF THE PREFERRED EMBODIMENT

In the following description and in the accompanying drawings, the numeral numbers refer to identical parts in the various Figures.

Figure 1:
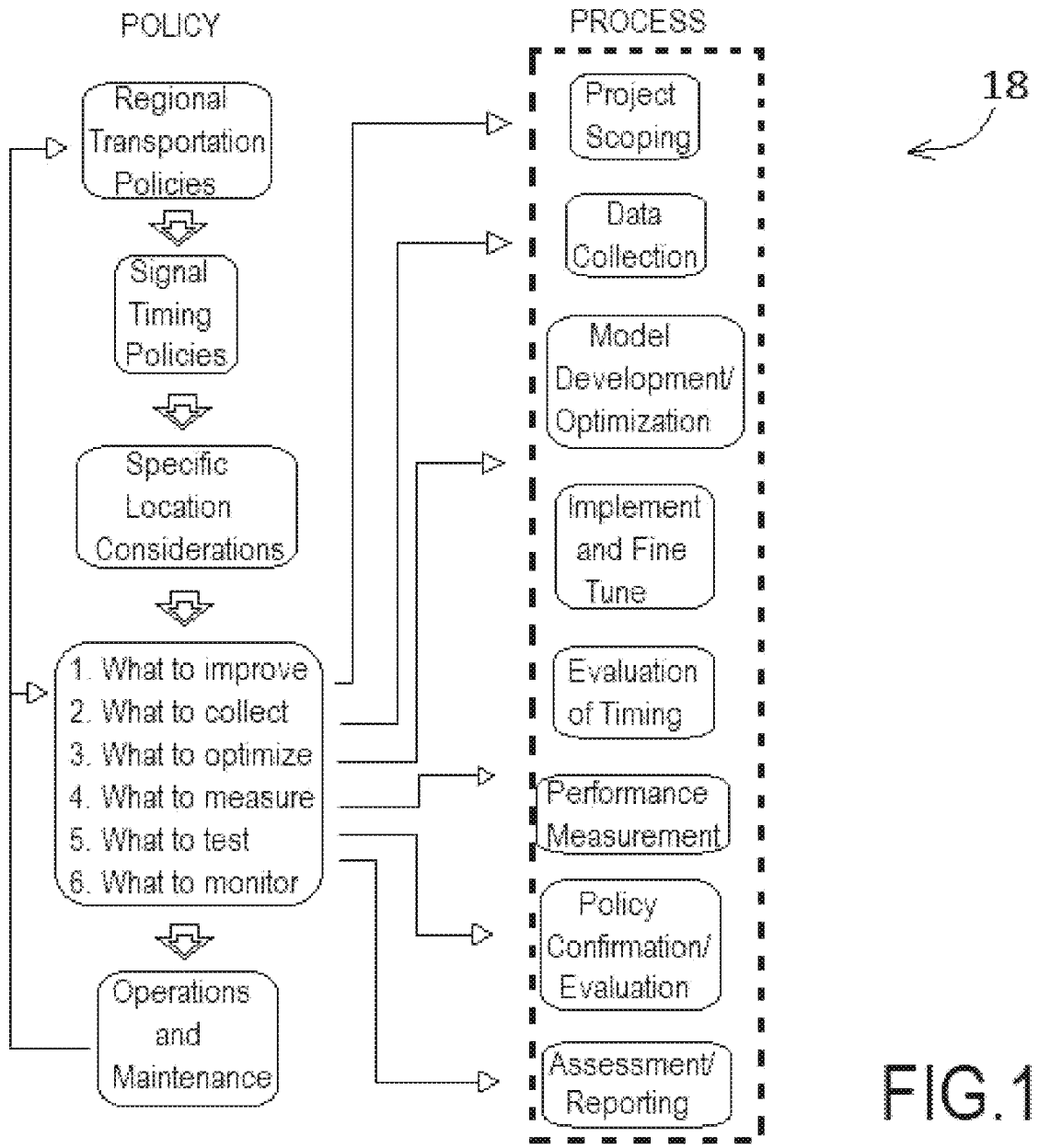
FIG. 1 is a plan of a signal timing environment from the Prior Art.

FIG. 1 shows a signal time process plan 18 from the *Traffic Signal Timing Manual* published by the "Institute of transportation engineers", 2009. The figure shows the process to be realized in order to develop, to program and to implement current traffic lights systems (Static or adaptive with detection loops). This process respect the norms, standards, rules, transport laws, specific local considerations, operations and maintenance rules, and internationally recognized methods for traffic control and TLS.

Figure 2:
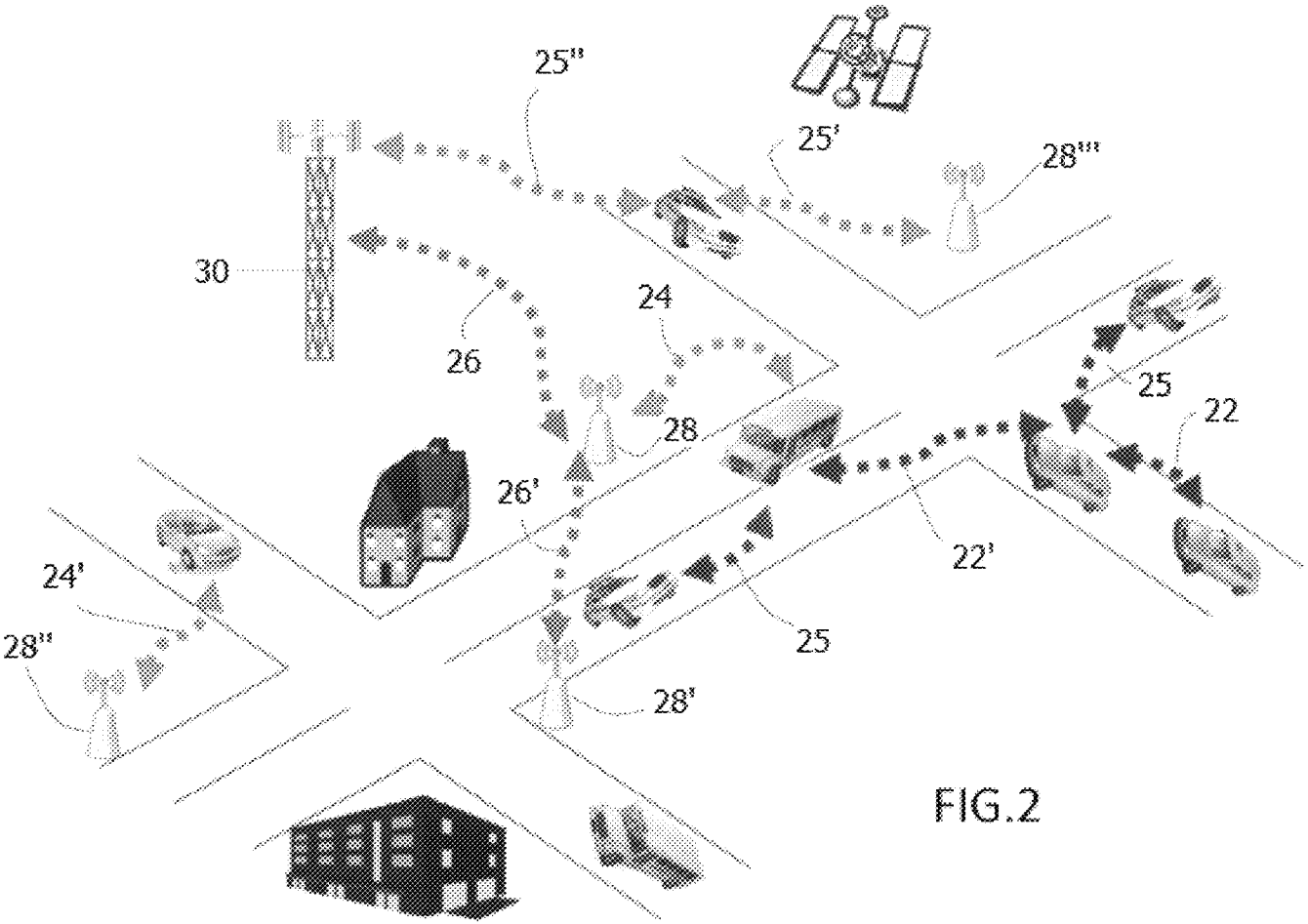
FIG. 2 is a view of a vehicular ad hoc network (VANET) system.

FIG. 2 shows how VANET (Vehicular's Ad hoc NETwork) works, there are three kinds of intercommunications:

- inter-vehicle communication 22,22' each vehicle can receive information from other vehicles every split second (0.1 sec or less) regarding their status in a range currently of about 300 meters.
- This information is transmitted 24,24' to communication stations (Road Side Unit—RSU) installed along the road, it is a vehicle-to-roadside communication.
- And the stations along the road RSU relayed information 26 to the base Station 30 (inter-roadside communication).

These data are about speed, acceleration, the braking system and so on. This information is much more accurate than the data collected by the usual methods (for example by manual counting, detection loop or origin-destination survey). There are also 25 which is a signal between police communication towards drivers, 25' which is a police communication towards a RSU, and 25" which is a police communication towards the base station 30.

Figure 3:
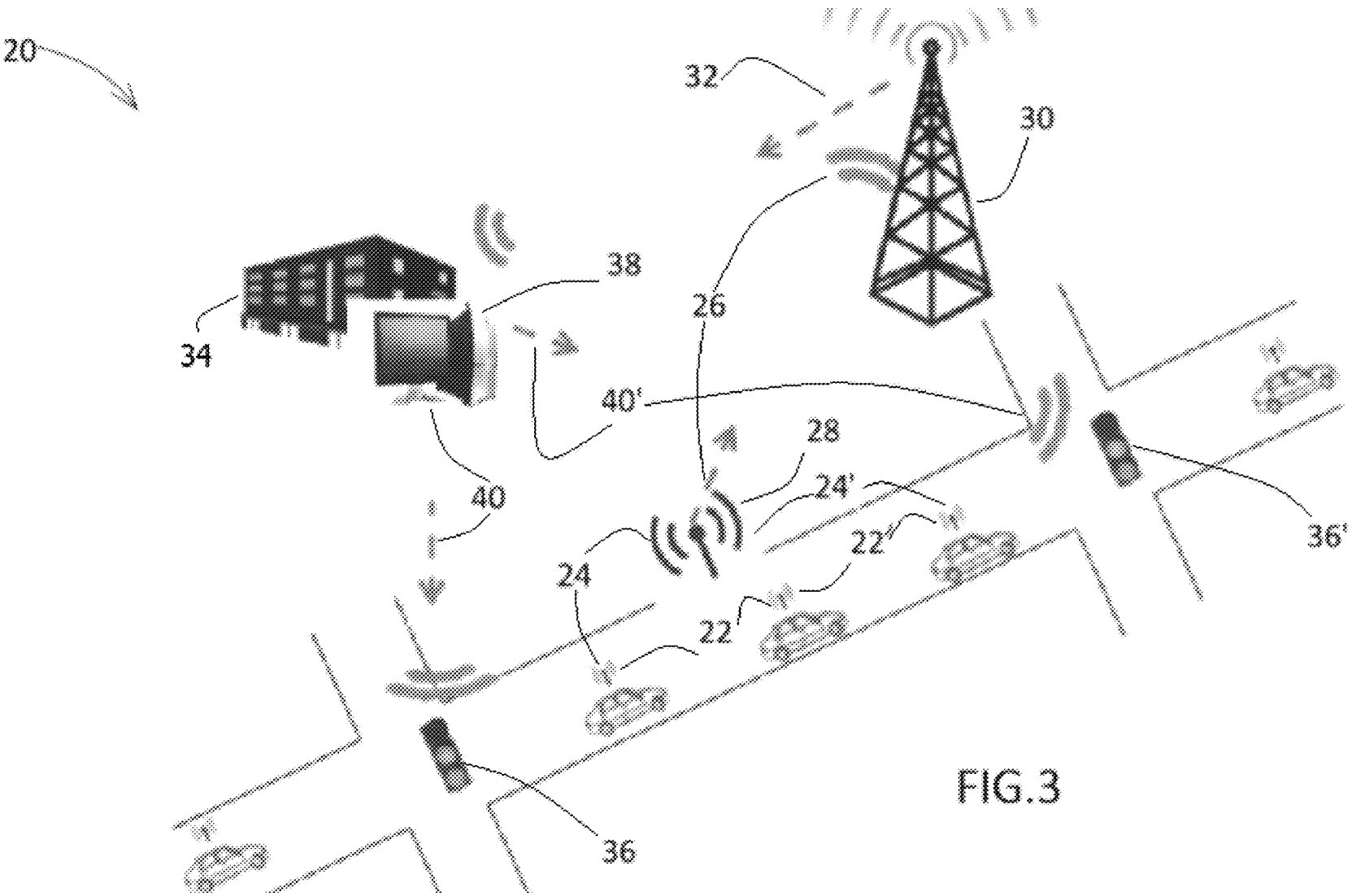
FIG. 3 is a view of the current invention.

FIG. 3 shows the method 20 of the present invention used to command the traffic light; each vehicle is sending data 22,22' to others vehicles on the road or 24,24' to RSU 28, the data is transferred to the computer control center 34 which operates an algorithm 38 producing signals 40,40' used to respectively program the traffic signals 36,36'. The first steps are those of VANET: the data 22,22' provided and exchanged by each vehicle are sent 24,24' to road side unit antenna 28, and the road side unit antenna send a signal 26 to the base station 30. The base station sends a signal 32 to the control center 34.

Figure 4:
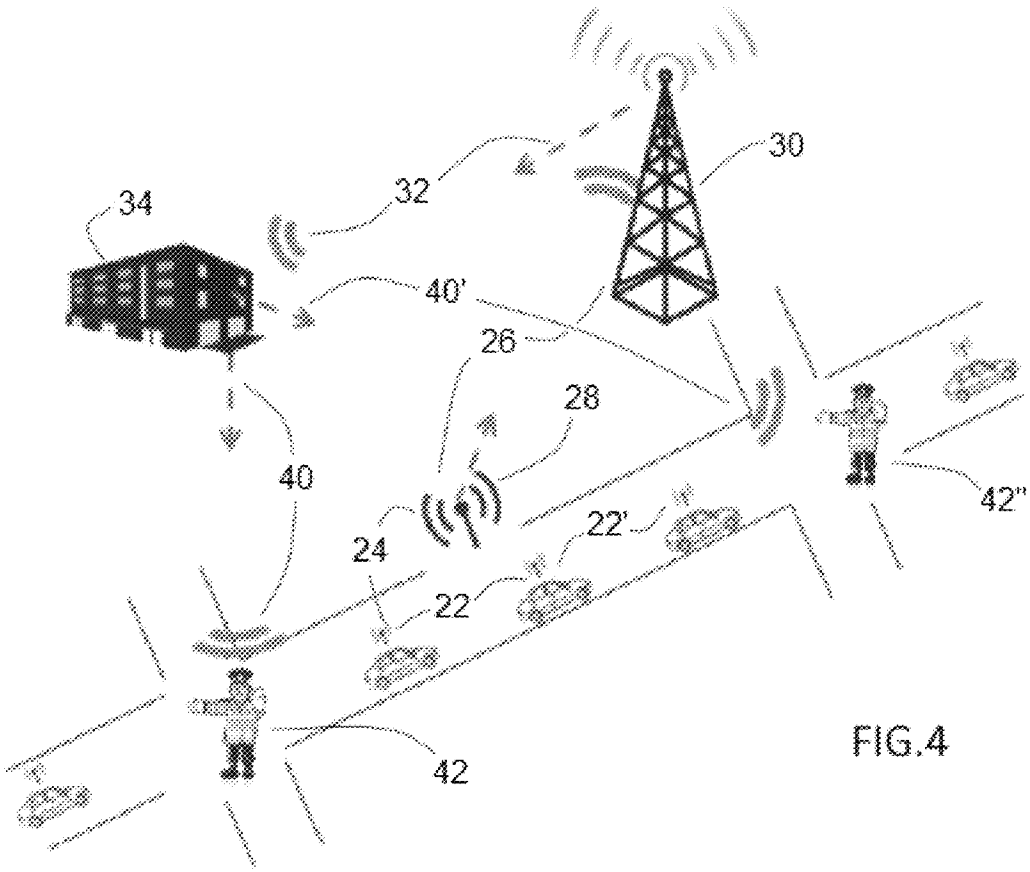
FIG. 4 is a view of the current invention also used to help traffic officers to control circulation.

FIG. 4 shows the method of the present invention used to manage circulation during events, such as sport events, cultural, parades, construction perturbation, manifestations and so on; the computer control centre 34 analyze the data 32 received by the base station 30 and send signals 40,40' to each traffic officers 42,42' in order to manually conduct traffic during events. One also sees inter-vehicle communication 22, 22', each vehicle can receive information from other vehicles every split second (0.1 sec or less) regarding their status in a range of about 300 meters. Said information is transmitted 24 to road side Unit 28 installed along the road, and the road RSU relayed information 26 to the base Station 30 (inter-roadside communication) which transferred it 32 to the computer control center in order to provide a signal which permits to manually conduct the traffic during non-functioning of the TLS.

Figure 5:
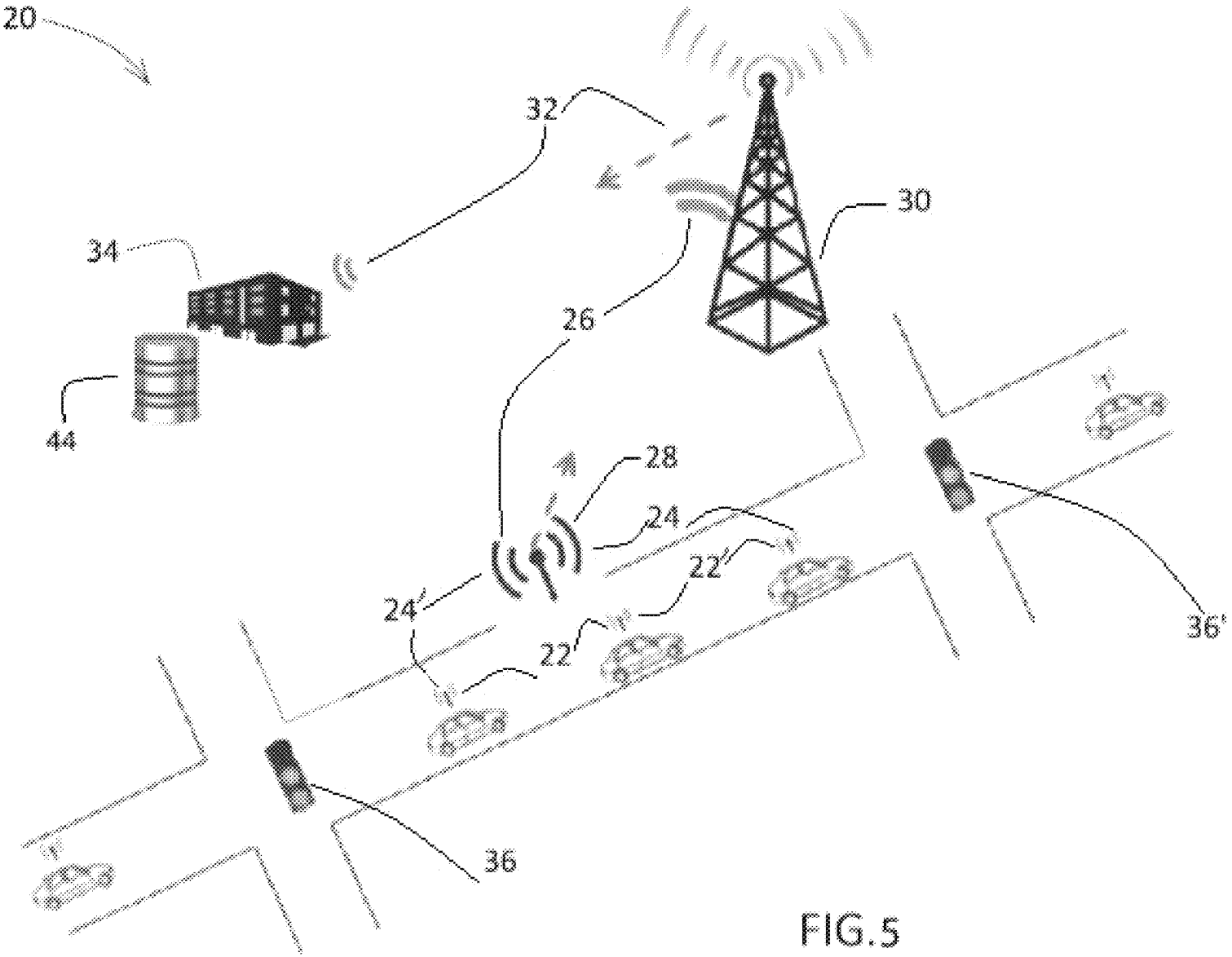
FIG. 5 is a view of the current invention used to stock data and use them to program the current TLS.

FIG. 5 shows a data base symbol 44, in the control center 34, the traffic data 32 provided by the base station 30 are stored in the data base 44, the data and can be used for example in a simulator to do simulation or to program TLS as it is currently done for static and adaptive systems. Those data can also be used for urban studies. One also sees inter-vehicle communication 22, 22', each vehicle can receive information from other vehicles every split second (0.1 sec or less) regarding their status in a range of about 300 meters. Said information is transmitted 24,24' to communication stations, road side units (RSU) installed along the road, it is a vehicle-to-roadside communication. And the RSU relayed information 26 to the base Station 30 (inter-roadside communication), which transferred it 32 to the computer control center and in the database 44. The data base is used to stock data and to do simulation with those data as is currently done for static and adaptive systems. Those data can also be used for urban studies.

SUMMARY OF THE INVENTION

The present invention is a method for programming traffic lights signals (TLS) by using data provided by vehicular ad hoc network, VANET abbreviated, the system or method comprises the following steps:

a. choose a wireless medium to transfer said data from vehicles connected by the VANET system, b. transfer the data from VANET to a computer control centre that operating an algorithm used to intervene in the programmation of the traffic lights system. These data may be transferred by means of a radiocommunication tower towards the computer control center and/or by road side units. The frequencies of the transfer could be those approved according to the current norm IEEE.812.11p as in the operations of VANET. These standards can be modified, adapted, updated or replaced over time by the responsible authorities of VANET.

c. Process the data with the algorithm. An algorithm based on the average occupancy rate of each road segment could be use for example, but any accurate algorithm can also be use at the choice of the city, government agency or public administration.

d. Construct a secure communication system between the computer control centre and the traffic lights system. A dedicated internet network or a wireless communication are secure communication systems which could be use at this stage.

e. Install wireless devices at each intersection of the road which command the traffic lights. These traffic lights system may be static, semi-actuated, or fully-actuated as the actual systems.

f. Send the signal provided by the algorithm through the secure communication system towards the wireless devices.

With the present invention the risks of signal loss are minimal. The present invention permits to get data at any time. These data are relatives to speed, acceleration, brake system, and all data available by VANET standard. These data from VANET can be transferred to the computer control centre in real time at a minimum frequency of 0.1 seconds. These data makes it possible to program the currents TLS according to the process recommended by the Institute of Transportation Engineers (FIG. 1). These data and this system also makes it possible to control a TLS in real time.

The present invention is used to manage traffic lights during events, such as sport events, cultural, parades, construction perturbation, or manifestations. A decision-making center is established in order to give comprehensible and essential information to traffic officers who control the traffic during the events. The present invention could also be used to make urban studies and to plan transportation studies.

The data provided by VANET can be stored in a data base 44, and used in a simulator to represent actual traffic flow and driver's behaviour more accurately than current assumptions based on statistical laws (for example Poisson's Law).

The data are used to process traffic information at the computer control center or traffic control center and transmit messages to vehicle drivers to adjust their car driving behaviour so that vehicles can better circulate synchronously thus promoting the fluidity of the circulation as a whole.

The data are used to process traffic information from said computer control center and transmit signals to autonomous cars in order to adjust their speed and promote traffic flow.

The data are used to process traffic information from the computer control center and to transmit signal to TLS to modify the programming of traffic lights in order to promote fluidity of the traffic as a whole.

The present invention is used to process traffic information from the control center, to transmit messages to drivers, to transmit signals to autonomous cars, to modify the programming of traffic lights, to control systems at the entrances, to exit motorways, to facilitate the flow of traffic. The present invention is replacing the need to collect traffic data manually, by sensors or others means to program static traffic lights systems according to the methods in force.

In the present invention the norm IEEE 802.11p can be modified, adapted, updated, renamed or replaced over time by the responsible authorities of VANET.

In the present invention the norm IEEE 802.11p is modifiable, the norm can be adapted, updated, renamed or replaced according to the rules of international standardization bodies that may be different in some countries or regions of the world (whatever the name is given to the standard or the norm in relation to VANET).

It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the following claims.

PARTS

18 Prior Art, the signal timing process
20 Method of the present invention
22, 22',22",22'" Inter-vehicle communication
24,24',24",24'" vehicle-to-roadside communication
25 Police communication towards drivers
25' Police communication towards roadside antenna
25" Police communication towards base station
26,26' Roadside-to-base station communication
28,28',28",28'" Roads side antennas or Road Side Unit—RSU
30 Base Station
32 Signal
34 Control center
36,36' Traffic signals
38 Algorithm
40 Signal produces by the algorithm
42,42' Traffic officers
44 Data base symbol The embodiments of the invention in which an exclusive property or privilege is claimed are defined as follows:

1. A method for programming traffic lights systems with data from vehicular ad hoc network VANET, said data are relatives to all the data available with the IEEE.802.11p standard; and said standard can be modified, adapted, updated, renamed or replaced over time by the responsible authorities, said method comprises the following steps:

a. choose a wireless medium to transfer said data from vehicles connected by the VANET,
b. transfer said data from vehicles connected by the VANET to a Traffic Control Center in real time at a minimum frequency of 0.1 seconds,
c. select a traffic light signals optimization algorithm,
d. process said data with said traffic light signals optimization algorithm,
e. use a secure communication system between said Traffic Control Center and said traffic lights,
f. use traffic control devices installed at road network intersections to control said Traffic Lights Systems,
g. send the instruction as a signal provided by said traffic light signals optimization algorithm through said secure communication system towards said traffic control devices to modify the traffic light signals programs in real time, said method permit to provide accurate road traffic data in a simple, practical and economical way to manage the Traffic Lights Systems in real-time and to make traffic simulation analysis as needed.

2. The method of claim 1 is used to manage said Traffic Lights Systems during events.

3. The method of claim 2 wherein said events are included sporting events, concert events, festival events, parades events, special events, construction works, detour roads or manifestations.

4. The method of claim 2 wherein said Traffic Control Center gives comprehensible and essential information to traffic officers who control the traffic during said events.

5. The method of claim 1 or 2 wherein said Traffic Lights Systems are static control systems.

6. The method of claim 1 or 2 wherein said Traffic Lights Systems are adaptive semi-actuated systems.

7. The method of claim 1 or 2 wherein said Traffic Lights Systems are adaptive fully-actuated systems.

8. The method of claim 1 wherein said data are transferred by means of communication towers.

9. The method of claim 1 wherein said traffic lights signals optimization algorithm is based on an average occupancy rate of each road segment.

10. The method of claim 1 wherein said communication system is a dedicated internet network.

11. The method of claim 1, wherein said communication system is a wireless communication system.

12. The method of claim 1 is used to make urban studies and to plan transportation studies.

13. The method of claim 1 wherein said data are used in a traffic circulation simulator in order to analyze traffic phenomena.

14. The method of claim 1 wherein said data are used to process traffic information at said Traffic Control Center and transmit messages to vehicle drivers to adjust driving behaviour so that vehicles can move more smoothly to improve traffic flow and mobility.

15. The method of claim 1 wherein said data are used to process traffic information from said Traffic Control Center and to transmit signals to autonomous cars in order to improve traffic flow.

16. The method of claim 1 is used to process traffic information from the Traffic Control Center, to transmit messages to drivers, to transmit signals to autonomous cars, to modify the programming of traffic lights, to control systems at the entrances, to exit motorways in order to improve traffic flow.

17. The method of claim 1 is replacing the need to collect traffic data manually, by sensors or by others means to adjust actual Traffic Lights Systems according to the current methods in force.

18. The method of claim 1 wherein said secure communication system is an optical fiber.

19. The method of claim 1 wherein said secure communication system is a secure mean.

20. The method of claim 19 wherein said secure mean is encrypted.

21. The method of claim 20 wherein said secure mean is a recognized and valid secure method.

* * * * *